US006355892B1

(12) United States Patent
Marks

(10) Patent No.: US 6,355,892 B1
(45) Date of Patent: Mar. 12, 2002

(54) ONE PIECE POWER TOOL TRIGGER WITH LOCK AND RETURN SPRING

(75) Inventor: Joel Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 09/630,797

(22) Filed: Aug. 2, 2000

(51) Int. Cl.[7] ..... H01H 9/20
(52) U.S. Cl. ..... 200/332.2; 200/43.17
(58) Field of Search ..... 200/43.01, 43.16, 200/43.17, 43.19, 43.21, 61.85, 522, 318, 318.1, 318.2, 323–325, 327, 329, 332.2

(56) References Cited

U.S. PATENT DOCUMENTS 3,646,298 A * 2/1972 Weber et al. ..... 200/157
3,854,020 A * 12/1974 Glover et al. ..... 200/321
4,054,766 A * 10/1977 Kramer ..... 200/157
4,064,447 A * 12/1977 Edgell et al. ..... 320/2
4,271,342 A * 6/1981 Sistare ..... 200/157
5,223,770 A * 6/1993 Schlessmann ..... 318/17

* cited by examiner

*Primary Examiner*—Michael Friedhofer
(74) *Attorney, Agent, or Firm*—Brad I Golstein

(57) ABSTRACT

An improved trigger to activate a switch for power actuated devices is disclosed. A one piece molded part provides a return spring and a trigger lock as an element of the trigger. Both the return spring and the lock include extended resilient portions to allow motion of the return spring and the lock in relation to the body of the trigger. Either one or both of the lock and the return spring may be a part of the trigger of the invention.

14 Claims, 4 Drawing Sheets

ONE PIECE POWER TOOL TRIGGER WITH LOCK AND RETURN SPRING

FIELD OF THE INVENTION

The present invention relates to power actuated devices. More precisely the present invention discloses a simplified locking trigger switch for an electric hand tool.

BACKGROUND OF THE INVENTION

Hand held power tools commonly have a trigger switch whereby depressing the trigger by a finger causes the tool's power element to become energized. Power tools operated this way include electric drills, staple guns, saws, sanders among other devices. Various home and kitchen appliances also may have a finger trigger switch. Numerous other devices use some type of trigger switch.

A trigger switch usually must have a biasing means to return the switch to its initial condition. A user's finger acts against this biasing means. An option to lock the trigger against being depressed may also be required, especially when safety is a factor in the operation of the device.

In the case of electric power hand tools the trigger often moves in a linear motion within straight guides of the tool housing. A metal spring presses the switch toward an extended position. In the case of an electric staple or nail gun a trigger lock is typically provided. The common design of this lock includes a plastic bar which may be moved from side to side in the region of the housing where the tool is gripped by a user's hand. Pressing the lock bar from one side moves the bar to engage the trigger. The switch cannot be moved and the tool cannot be fired. Pressing the lock bar from the other side frees the trigger to engage the switch.

The typical lock bar is a separate part of the trigger assembly. It is difficult to use since it is often engaged or disengaged accidentally as the tool is grasped by a hand. It is also not intuitive which direction to press the lock bar. One must either read the printed information adjacent to the lock bar on the housing, when such information is provided, or try to operate the trigger to find whether the lock is engaged. Naturally it is less safe when the condition of the trigger lock is not immediately obvious.

SUMMARY OF THE INVENTION

In the present invention an improved trigger mechanism is disclosed. The trigger is directed to application in a staple or nail gun. However other power actuated devices may also benefit from the trigger of the present invention.

A plastic trigger is rotatably mounted in a tool body. Compared to a linear sliding trigger a rotating trigger operates with less friction since the rotating trigger contacts the housing body slidably only in a gentle guiding action. A linear motion trigger will move with friction that strongly depends on how the finger pressure is applied, with a low friction condition being only when the trigger is pressed directly in the direction of motion. However it is possible to include the features of the present invention in a linear motion trigger with the same benefits described herein for the preferred embodiment rotating trigger.

In the present invention the separate metal reset spring of the prior art is replaced by an extended resilient reset arm of the trigger. Especially when combined with a low friction rotatable trigger, the resilient arm provides an efficient reset action without the use of an additional part.

A further improvement of the invention comprises a locking tab. Being a second resilient extension of the trigger body, the locking tab has a distal end that is normally spaced apart from the trigger body. Moving the tab toward the trigger body causes an element of the tab to prevent the trigger from being depressed. The tab is pulled away from the trigger to disengage the lock.

The locking tab of the present invention is more intuitive than the prior art locking devices since the condition of the tab is visually obvious. When locked the tab is touching the trigger body, when it is unlocked the tab is separate from the trigger body. Importantly the locking tab is not affected by grasping the tool since it is not in an area that is prone to accidental contact.

In the unlocked condition the locking tab moves along with the trigger when the trigger is pressed. In the locked condition the locking tab is restrained against a surface of the tool body.

A feature of the present invention is that three separate functions can be served using a single molded device. Specifically a reset spring and a trigger lock are molded as part of a trigger body.

DETAILED DESCRIPTION OF THE ILLUSTRATED EMBODIMENT

A staple or nail gun housing body 10 is shown in the illustrated embodiment. The trigger of the invention may also be of benefit when used in other power tools such as drills, saws or sanders. The trigger may also be used in other non-tool devices where a low cost simplified trigger mechanism is desired.

Figure 2:
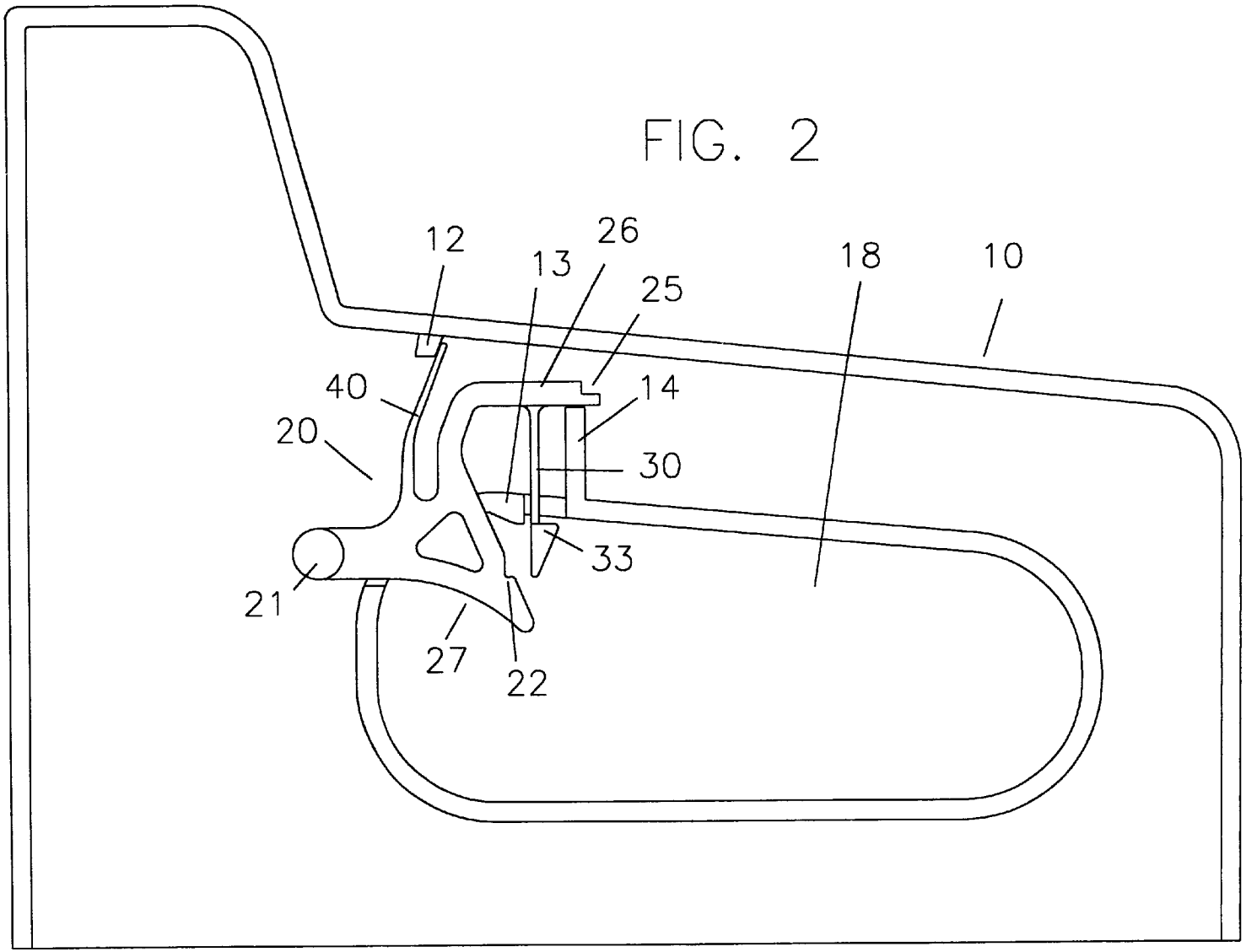
FIG. 2 is a side elevation of a simplified interior of a staple gun showing internal features of the trigger of FIG. 1.

FIG. 2 shows the essential features of the invention. The trigger is in an extended position. Trigger body 20 is rotatably fitted within housing body 10 about pivot 21. Pivot 21 comprises a post of trigger 20, where pivot 21 fits into a corresponding recess, not shown, of housing body 10. Optionally the post could be a part of housing body 10, fitting into a recess of trigger 20. A user presses trigger face 27 to depress trigger 20 by rotation about pivot 21. Actuating end 25 is at the distal end of semi rigid arm 26 of trigger body 20. Actuating end 25 operates a switching device such as a valve or electrical contact, not shown. Arm 26 is partly flexible so that misalignments or other errors cannot cause excess force to be applied to the switch or valve. A further benefit of arm 26 is described later.

Spring arm 40 extends away from trigger body 20. The distal end of spring arm 40 presses stop 12 of housing body 10. Preferably spring arm 40 includes a decreasing sectional area toward the distal end to increase the efficiency of the resilient spring action.

Spring 40 need not be limited to an elongated arm. For example an arcuate shape resembling an automotive leaf spring or a zigzag shape resembling a coiled spring could function if designed and attached appropriately.

Figure 1:
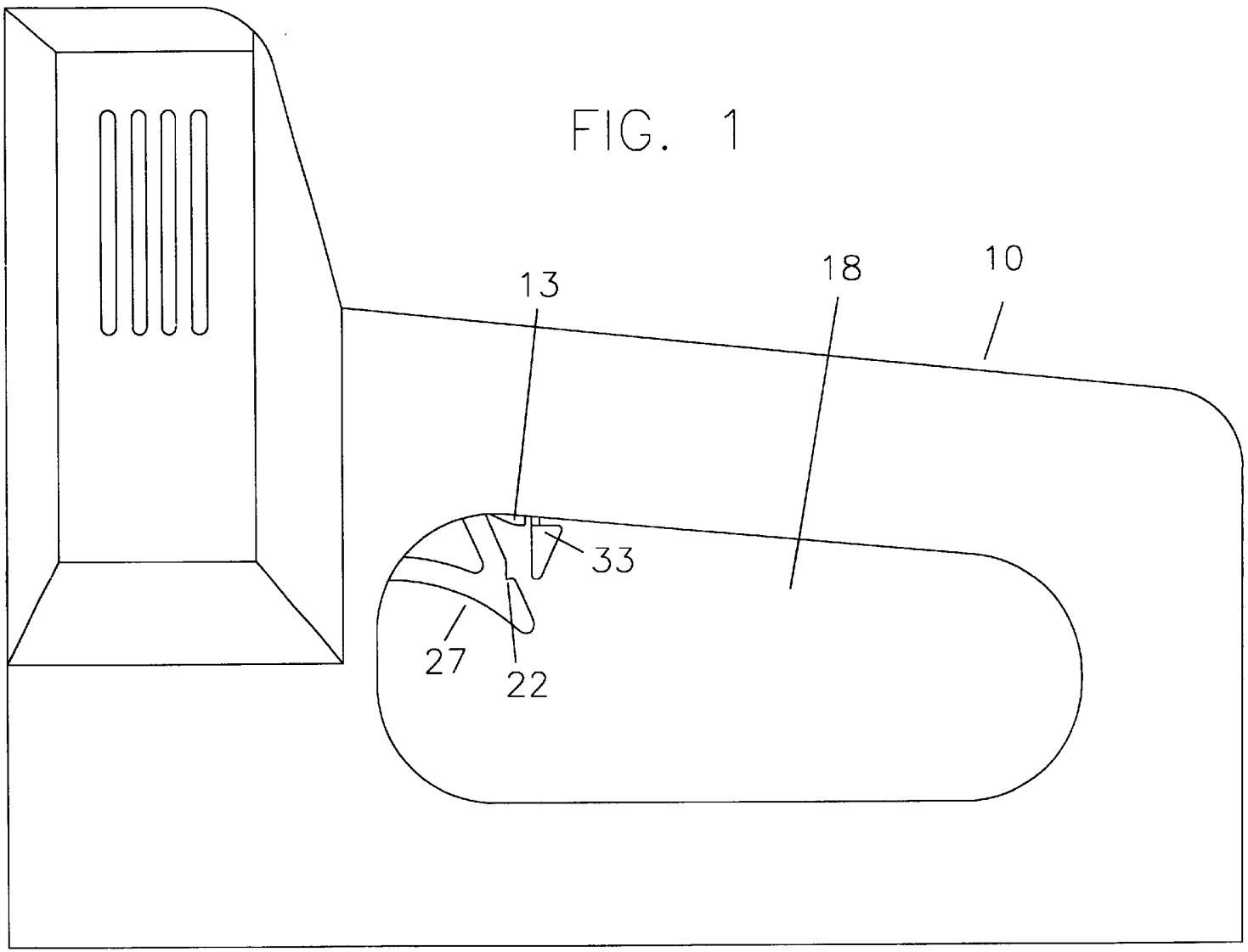
FIG. 1 is side elevation of an exemplary electric staple gun showing external features of a preferred embodiment of a trigger, where the trigger is unlocked.

Preferably spring arm 40 retains a slight preload when it is in the extended position of FIGS. 1 and 2 so that the trigger does not rattle.

Trigger lock 33 is at the distal end of locking arm 30. Locking arm 30 is flexible to allow trigger lock 33 to move toward and away from trigger body 20. Similar to spring arm 40, locking arm 30 need not be a simple elongated form.

When trigger lock 33 is in the rear position shown in FIG. 1 and FIG. 2 trigger body 20 is free to rotate upward against the bias of spring arm 40. The widened trigger lock 33 can pass into opening 17 of housing body 10, seen in FIG. 4 and FIG. 6. Lock 33 moves along with trigger body 20.

Figure 4:
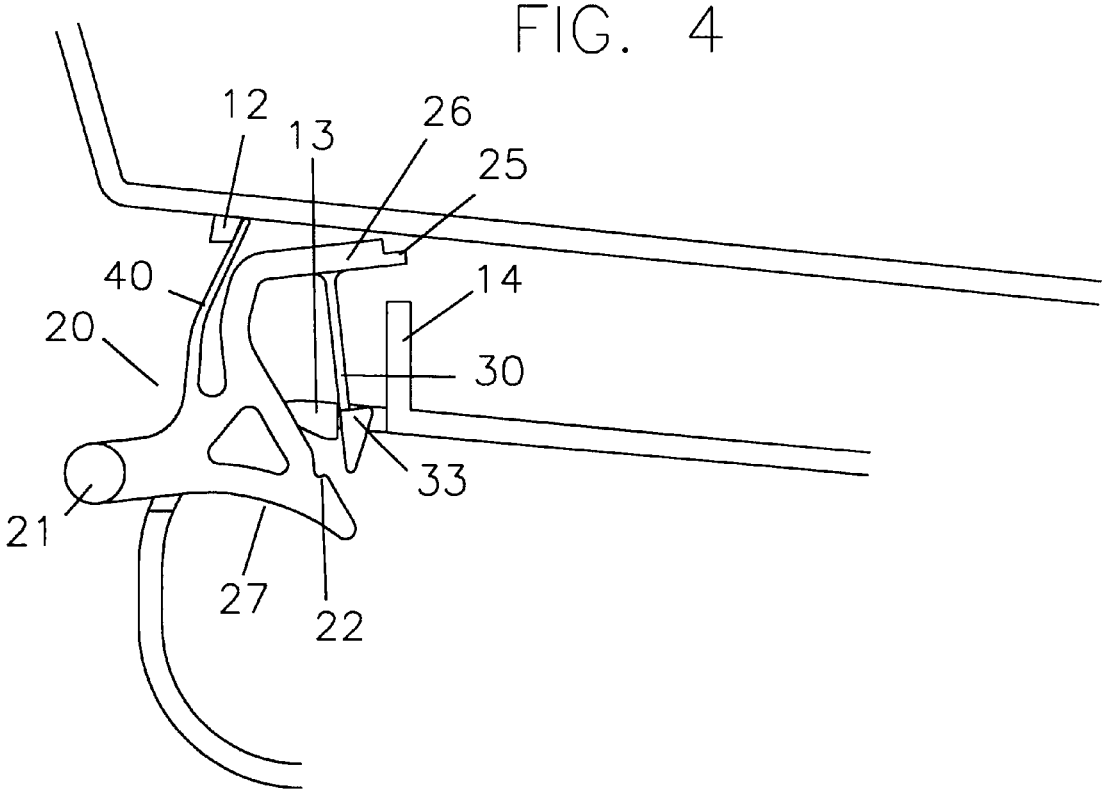
FIG. 4 is an interior detail view of a staple gun where the trigger is depressed against the bias of a reset spring.
Figure 5:
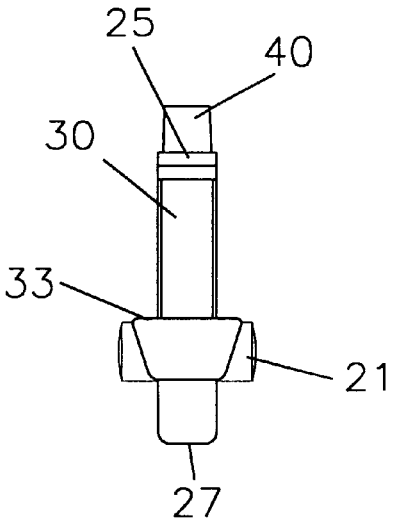
FIG. 5 is a rear elevation of the trigger of FIGS. 3A and 4.

In FIG. 4 the trigger is in a depressed position. Spring arm 40 is deflected from the condition shown in FIG. 2. Trigger lock 33 is within opening 17. Actuating end 25 has moved within housing body 10. A switch or valve, not shown, is forced into an "on" condition by actuating end 25 being in the state shown in FIG. 4.

Figure 3:
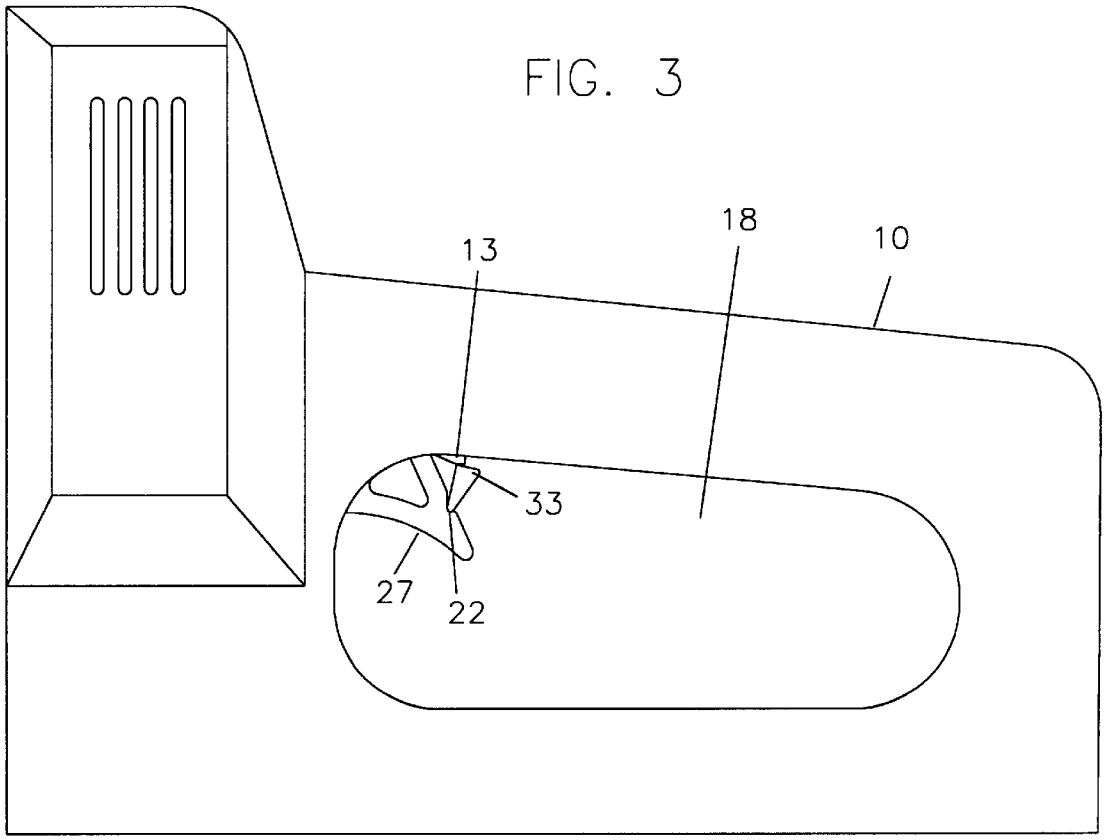
FIG. 3 is a side elevation of the staple gun of FIG. 1, with the trigger locked.
Figure 3A:
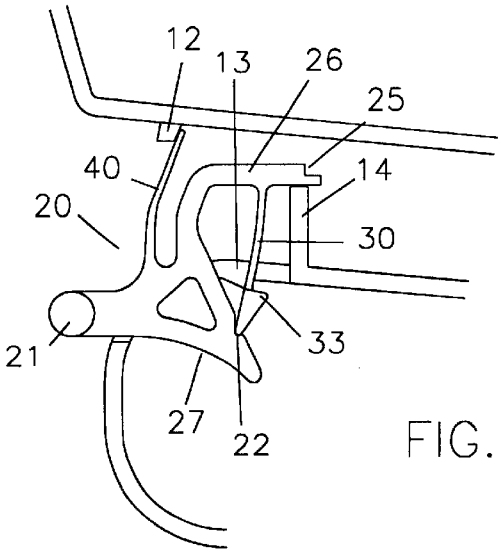
FIG. 3A is an interior detail view of the trigger of FIG. 3.

In FIG. 3 lock 33 has been pushed forward to engage lock notch 22 of trigger body 20. Slight flexibility of arm 26 helps locking arm move upward and the bottom edge of trigger lock 33 to ride up and over a retaining ridge of lock notch 22. Forcibly pulling rearward on trigger lock 33 will force it out of lock notch 22. A second way to release trigger lock 33 is to press downward upon trigger body 20 just behind and below lock notch 22. Stop rib 14 of housing body 10 prevents the trigger from moving downward too far by restraining arm 26. But since arm 26 is slightly flexible, pressing downward on the trigger causes arm 26 to deflect whereby trigger lock 33 lifts out of lock notch 22. The resilient action of locking arm 30 then causes lock 33 to separate from trigger body 20 to assume the condition of FIGS. 1 or 2. However it is not required that actuating end 25 be attached to a distinct arm. If trigger body 20 is prevented from moving by lock 33, actuating end 25 could be a rigidly attached part of trigger body 20. If locking arm 30 were sufficiently flexible then deflection of locking arm 30 would be enough to allow installing and removing lock 33 from lock notch 22.

Figure 6:
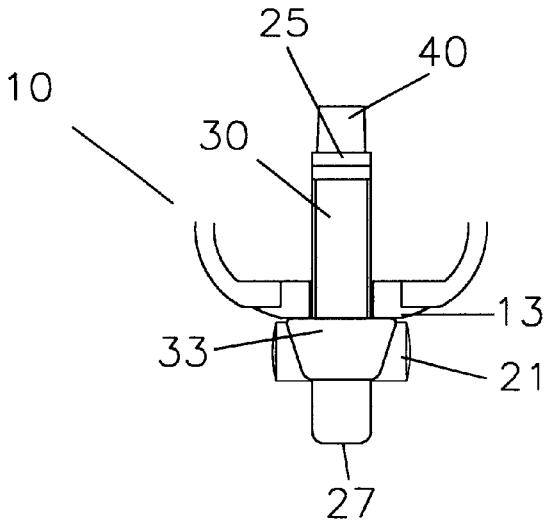
FIG. 6 is the trigger of FIG. 5 surrounded by an exemplary partial section of a tool housing.

When in the locked condition of FIG. 3 lock 33 is under blocking tab 13. More specifically the wide ends of lock 33 are under two blocking tabs 13, as seen in FIG. 6. Lock 33 then spans the gap between lock notch 22 and locking tabs 13 as in FIG. 3. Lock 33 is a substantially rigid body that prevents trigger body 20 from rotating upward in housing 10.

Lock 33 could engage a multiple stepped tab 13 so that each step corresponds to different lock positions of the trigger. This would be useful for example in a variable speed motorized device where conditions between "on" and "off" are to be maintained.

In a variation lock 33 could be forced rearward to engage a correspondingly positioned surface of trigger body 20 and housing body 10. In a further variation lock 33 could directly engage a notch or rib of housing body 10. According to this design the flexibility of arm 26 would allow motion of the trigger. But since lock 33 is held from moving relative to housing body 10, actuating end 25 will not move within the housing. While the preferred embodiment above relies upon compression of lock 33 to hold the trigger from moving, the present alternate embodiment uses tension along lock bar 30 to prevent motion of only the distal end of arm 26 at actuating end 25. This design will be preferable when it is desired to allow forcible motion of the trigger in all conditions. For example if the trigger mechanism is not strong enough to resist abusive force from a strong user, it may be best to allow motion of the trigger while preventing motion only at actuating end 25. In any case when locked, lock 33 and at least actuating end 25 cannot move relative to housing body 10.

The options described above are similar to an issue of car door design. Older cars used a positive lock action where the door button could not be moved when locked. Newer cars allow motion of the button or lever when locked while an internal element is disabled.

In a tool such as a staple gun the positive locking action is preferred to give a user direct feedback of the lock condition. A movable locked state might be mistaken for a malfunction. However other devices may work best with the movable lock condition.

The benefit of the invention does not require that both the reset spring and lock be included in a trigger device. Either feature alone provides a simplified and improved trigger device. The reset spring and lock are similar in that they make use of a resilient portion of a trigger body in their function. The resilient portions are molded as an integrated part of a plastic trigger body. The present invention trigger is a low cost design which combines the function of two or three components into one plastic part.

The preferred embodiment trigger is rotatably mounted about pivot 21. However a linear sliding type trigger would also be able to include one or both of the resilient reset spring and lock. For example the arcuate spring described above would be well suited to bias the straight motion of a linear sliding spring in the same manner that the similar leaf spring in a car allows up and down axle motion. One or preferably two cantilevered springs similar to spring 40 may also be used to bias a linear sliding trigger. A single lock such as lock 33 would be adequate to restrain a linear sliding trigger. In any version more than one lock may be desired. Whether the trigger slides or rotates the reset spring and lock of the invention are molded as attached pieces of the trigger.

FIGS. 1 and 2 show the trigger in an extended position. FIG. 4 shows the trigger in a depressed position. The extended position may also be considered an initial position. It is a matter of design choice whether the extended or initial position of the trigger is further from a tool or other device body than the depressed position. It is typical that the extended position corresponds to a trigger finger being extended further from the hand.

Although the present invention has been described in a preferred embodiment, modifications may be anticipated without departing from the spirit and scope of the invention as claimed herein.

What is claimed is:

1. A molded plastic trigger movable between an extended position and a depressed position to operate a switch, valve, or other control element within a housing of a power actuated device, the trigger comprising:

an actuating end engaging the switch, valve, or other control device;

a resilient reset spring molded as a part of the trigger wherein the reset spring contacts a surface of the housing, the reset spring biasing the trigger toward the extended position;

a lock molded as a part of a resilient lock arm of the trigger wherein the lock may rest in at least two distinct positions, a first position and a second position;

the first position of the lock enabling the trigger to move from the extended position to the depressed position when the trigger is forcibly biased toward the depressed position, and the actuating end and the lock move along with the trigger between respective extended and depressed positions;

the second position of the lock restraining at least the lock and the actuating end from moving from the extended position to the depressed position, wherein when the trigger is forcibly biased toward the depressed position the lock presses an element of the housing.

2. The trigger of claim 1 wherein the second position of the lock restrains the trigger from moving to the depressed position.

3. The trigger of claim 2 wherein the lock is held in a notch of the trigger when the lock is in the second position.

4. The trigger of claim 1 wherein the actuating end comprises the distal end of an elongated arm of the trigger, and the resilient lock arm has a base end attached to the elongated arm.

5. The trigger of claim 4 wherein the elongated arm presses a stop of the housing at a location of the elongated arm proximal to the actuating end when the trigger is in the extended position.

6. The trigger of claim 1 wherein the resilient reset spring is an elongated cantilevered extension of the trigger, and in which a distal end of the reset spring contacts the surface of the housing.

7. The trigger of claim 6 wherein the reset spring decreases in cross section from a base toward the distal end of the reset spring.

8. The trigger of claim 1 wherein the trigger rotates about a pivot between the extended position and the depressed position.

9. A molded plastic trigger movable between an extended position and a depressed position to operate a switch, valve, or other control element within a housing of a power actuated device, the trigger comprising:

an actuating end engaging the switch, valve, or other control device;

a lock molded as a part of a resilient lock arm of the trigger wherein the lock may rest in at least two distinct positions, a first position and a second position;

the first position of the lock enabling the trigger to move from the extended position to the depressed position when the trigger is forcibly biased toward the depressed position, and the actuating end and the lock move along with the trigger between respective extended and depressed positions;

the second position of the lock restraining at least the lock and the actuating end from moving from the extended position to the depressed position, wherein when the trigger is forcibly biased toward the depressed position the lock presses an element of the housing.

10. The trigger of claim 9 wherein the second position of the lock restrains the trigger from moving to the depressed position.

11. The trigger of claim wherein 10 the lock is held in a notch of the trigger when the lock is in the second position.

12. The trigger of claim 9 wherein the actuating end comprises a distal end of an elongated arm of the trigger, and the resilient lock arm has a base end attached to the elongated arm.

13. The trigger of claim 12 wherein the elongated arm presses a stop of the housing at a location of the elongated arm proximal to the actuating end when the trigger is in the extended position.

14. The trigger of claim 9 wherein the trigger rotates about a pivot between the extended position and the depressed position.

* * * * *